US011826005B2

(12) United States Patent
Fawaz et al.

(10) Patent No.: US 11,826,005 B2
(45) Date of Patent: Nov. 28, 2023

(54) EXHIBITING A DISHWASHER RACK TO THE USER

(71) Applicant: Midea Group Co., Ltd., Foshan (CN)

(72) Inventors: Bassam Fawaz, Louisville, KY (US); Robert M. Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 53 days.

(21) Appl. No.: 17/707,374

(22) Filed: Mar. 29, 2022

(65) Prior Publication Data

US 2023/0309785 A1 Oct. 5, 2023

(51) Int. Cl.
*A47L 15/50* (2006.01)
*A47L 15/42* (2006.01)

(52) U.S. Cl.
CPC ..... *A47L 15/507* (2013.01); *A47L 15/4257* (2013.01)

(58) Field of Classification Search
None
See application file for complete search history.

(56) References Cited

U.S. PATENT DOCUMENTS

| | | | |
|---|---|---|---|
| 3,466,108 | A | 9/1969 | Guth |
| 7,455,066 | B2 | 11/2008 | Feddema et al. |
| 8,163,103 | B2 | 4/2012 | Shin et al. |
| 8,387,634 | B2 | 3/2013 | Dalsing |
| 9,629,515 | B2 | 4/2017 | Chan et al. |
| 10,405,731 | B2 | 9/2019 | Harr |
| 10,765,292 | B2 | 9/2020 | Ko et al. |
| 10,779,705 | B2 | 9/2020 | Ko et al. |
| 10,813,531 | B2 | 10/2020 | Hansen et al. |
| 11,006,814 | B1 | 5/2021 | Simmonds |
| 11,064,861 | B2 | 7/2021 | Ploszaj et al. |
| 2021/0000325 | A1 | 1/2021 | Ko |
| 2021/0177237 | A1 | 6/2021 | Feddema |
| 2021/0186300 | A1 | 6/2021 | Nearpass et al. |

FOREIGN PATENT DOCUMENTS

| | | | | |
|---|---|---|---|---|
| EP | 1854395 | A1 | 11/2007 | |
| WO | WO-2016184494 | A1 * | 11/2016 | ..... A47L 15/507 |
| WO | 2019170675 | A1 | 9/2019 | |
| WO | 2020216444 | A1 | 10/2020 | |

OTHER PUBLICATIONS

Transmittal of Related Applications dated Mar. 30, 2022.

* cited by examiner

*Primary Examiner* — Rita P Adhlakha
(74) *Attorney, Agent, or Firm* — Gray Ice Higdon

(57) ABSTRACT

A rack for an appliance such as a dish washing appliance. Deployment of the rack may allow the user to become aware of the presence of the rack within the dish washing appliance. At least one rack is positionable from a stowed position to at least one deployed position. The rack may be deployed or actuated with a door and/or a second rack. The door and/or second rack may carry, force, or actuate the rack to a deployed position. The deployed position of the rack may not be a fully deployed position of the rack.

20 Claims, 13 Drawing Sheets

EXHIBITING A DISHWASHER RACK TO THE USER

BACKGROUND

The present embodiments relate to rack or drawer, with particular embodiments shown for a dishwasher rack of a dishwasher appliance.

Typical dishwasher racks may be positionable between a stowed position within the dishwasher and a deployed position different from the stowed position to unload/load the contents of the rack. However, dishwasher racks may be of a size, shape, construction, and/or position within a dishwasher tub such that the user may be unaware of the presence of the one or more racks in the dishwasher. For example, but not limited to, an uppermost/third dishwasher rack may be unnoticed by the user because of a low profile paired with an interrupted viewing angle from above the dishwasher appliance. Thus, there is a need to make the user aware of the presence of one or more dishwasher racks, or portions thereof, and/or make the one or more dishwasher racks, or portions thereof, accessible to the user in a dishwasher appliance.

SUMMARY

In some embodiments of the invention, for example, a dish washing appliance may include a dishwasher tub having a front opening. In various embodiments, the appliance may include a rack engaging the dishwasher tub, wherein the rack may be positionable between a first stowed position in the dishwasher tub and a first deployed position different from the first stowed position. In some embodiments, the rack may include a first portion interconnected to a remaining portion by at least one biasing mechanism, wherein the first portion may be positionable between a second stowed position with the remaining portion and a second deployed position different from the second stowed position. In various embodiments, at least one biasing mechanism may urge the first portion to the second deployed position relative to the remaining portion towards the front opening of the dishwasher tub.

In various embodiments, the first portion may include a handle. In some embodiments, the rack may include one or more linkage members interconnecting the first portion to the remaining portion of the rack. In various embodiments, the appliance may include a door positionable between an open position and a closed position relative to the dishwasher tub, and wherein when the door opens from the closed position to the open position, the door actuates the first portion from the second stowed position to the second deployed position and correspondingly decreases a force of the biasing mechanism. In some embodiments, when the door closes from the open position to the closed position, the door may actuate the first portion from the second deployed position to the second stowed position and correspondingly increases the force of the biasing mechanism. In various embodiments, the first portion may travel at least linearly from the second stowed position to the second deployed position. In some embodiments, when the rack is in the first stowed position and the first portion is in the second deployed position, the first portion may be positioned through the front opening away from the dishwasher tub.

In some embodiments, a dish washing appliance may include a dishwasher tub having a front opening. In various embodiments, the appliance may include a rack engaging the dishwasher tub, wherein the rack may be positionable between a first stowed position in the dishwasher tub and a first deployed position different from the first stowed position. In some embodiments, the rack may include a handle and at least one biasing mechanism, wherein the handle may be positionable between a second stowed position and a second deployed position different from the second stowed position. In various embodiments, at least one biasing mechanism may urge the handle to the second deployed position towards the front opening of the dishwasher tub.

In addition, in some embodiments, the dishwasher tub may include a top wall, wherein the rack may be adjacent to the top wall. In various embodiments, the dishwasher tub may include a door positionable relative to the dishwasher tub, wherein the door may actuate the handle between the second stowed position and the second deployed position. In some embodiments, when opening the door relative to the dishwasher tub may decrease a force of the biasing mechanism. In various embodiments, the rack may include one or more linkage members interconnecting the handle to a remaining portion of the rack. In some embodiments, the handle may travel at least linearly from the second stowed position to the second deployed position. In various embodiments, the rack may include a front side, and wherein the handle is in the second stowed position adjacent the front side of the rack. In some embodiments, the handle may be positionable in the second stowed position and the second deployed position when the rack is in the first stowed position.

In various embodiments, a method of deploying a handle of a rack within a dish washing appliance may include providing a door positionable between a closed position and an open position relative to a dishwasher tub. In some embodiments, the method may include providing a dishwasher rack having a handle, a remaining portion, and a biasing mechanism between the handle and the remaining portion. In some embodiments, the method may include deploying the handle from a stowed position to a deployed position relative to the remaining portion of the rack when positioning the door from the closed position to the open position.

In addition, in some embodiments, the method may include decreasing a force of the biasing mechanism when positioning the door from the closed position to the open position, and/or increasing the force of the biasing mechanism when positioning the door from the open position to the closed position. In various embodiments, the method may include stowing the handle from the deployed position to the stowed position relative to the remaining portion of the rack when positioning the door from the open position to the closed position. In some embodiments, the method may include disengaging the door from the handle of the rack when positioning the door from the closed position to the open position. In various embodiments, the method may include biasing the handle towards a front opening of the dishwasher tub when the rack is in a stowed position.

In addition, in some embodiments, a dish washing appliance may include a dishwasher tub having a front opening. In various embodiments, the appliance may include a door positionable between an open position and a closed position relative to the dishwasher tub. In some embodiments, the appliance may include a rack engaging the dishwasher tub, wherein the rack may be positionable between a stowed position in the dishwasher tub and one or more deployed positions different from the stowed position. In various embodiments, the door may magnetically actuate the rack away from the stowed position to at least one deployed position of the one or more deployed positions.

In various embodiments, the door may include at least one of one or more magnetic members having at least one metal member and one or more magnets, and wherein the rack may include the other of the one or more magnetic members and the one or more magnets. In some embodiments, the door may magnetically separate from the rack when in at least one deployed position. In various embodiments, when magnetically separated from the door the rack may deploy to another deployed position further away from the stowed position than at least one deployed position. In some embodiments, when closing the door from the open position to the closed position, the door may magnetically couple to the rack. In various embodiments, when the rack is in at least one deployed position, a portion of the rack may be positioned through the front opening away from the dishwasher tub.

In addition, in various embodiments, a dish washing appliance may include a dishwasher tub having a front opening. In some embodiments, the appliance may include a door positionable between an open position and a closed position relative to the dishwasher tub, and wherein the door may include at least one of one or more magnetic members having at least one metal member and one or more magnets. In various embodiments, the appliance may include a rack engaging the dishwasher tub, wherein the rack may include the other of the one or more magnetic members and the one or more magnets, and wherein the rack may be positionable between a stowed position in the dishwasher tub and one or more deployed positions different from the stowed position, wherein the one or more deployed positions includes a first deployed position and a second deployed position that is further from the stowed position than the first deployed position. In some embodiments, when opening the door from the closed position towards the open position the rack may be deployed from the stowed position with the door corresponding to the one or more magnets magnetically engaging the one or more magnetic members until reaching the first deployed position when the one or more magnets magnetically disengage from the one or more magnetic members.

In various embodiments, wherein closing the door from the open position towards the closed position the one or more magnets may magnetically engage to the one or more magnetic members. In some embodiments, the door may include the one or more magnetic members and the rack may include the one or more magnets. In various embodiments, the door may include the one or more magnets and the rack may include the one or more magnetic members. In some embodiments, the rack may include a front side, wherein the front side may include the other of the one or more magnetic members and the one or more magnets. In various embodiments, the door may include an interior side and a top edge, wherein at least one of the one or more magnetic members and the one or more magnets may be positioned on the interior side and adjacent the top edge of the door. In some embodiments, the one or more magnets may be magnetically engaged to the magnetic members when both the door is in the closed position and the rack is in the stowed position. In various embodiments, when the rack is in the first deployed position, a portion of the rack may be positioned through the front opening away from the dishwasher tub.

In addition, in some embodiments, a method of deploying a dishwasher rack within a dish washing appliance may include providing a door positionable between a closed position and an open position relative to a dishwasher tub. In various embodiments, the method may include providing a dishwasher rack. In some embodiments, the method may include magnetically engaging the door to the dishwasher rack. In various embodiments, the method may include deploying the dishwasher rack from a stowed position to a deployed position when positioning the door from the closed position to the open position.

In various embodiments, the method may include magnetically disengaging the door from the dishwasher rack when in the deployed position. In some embodiments, when the dishwasher rack is in the deployed position, a portion of the dishwasher rack may be positioned through a front opening of the dishwasher tub away from the dishwasher tub. In various embodiments, the method may include deploying the dishwasher rack further from the stowed position when the dishwasher rack is magnetically disengaged from the door or stowing the dishwasher rack towards the stowed position when the dishwasher rack is magnetically disengaged from the door. In some embodiments, the method of magnetically engaging may include a magnet engaging a magnetic member, wherein the magnetic member may include a metal member. In various embodiments, the method of magnetically engaging occurs when the door is in at least the closed position and the dishwasher rack is at least in the stowed position.

In addition, in some embodiments, a dish washing appliance may include a dishwasher tub having a front opening. In various embodiments, the appliance may include a first rack engaging the dishwasher tub, wherein the first rack may be positionable between a first stowed position in the dishwasher tub and a first deployed position different from the first stowed position. In some embodiments, the appliance may include a second rack engaging the dishwasher tub, wherein the second rack may be positionable between a second stowed position in the dishwasher tub and a second deployed position different from the second stowed position. In various embodiments, wherein deploying the second rack from the second stowed position to the second deployed position correspondingly may deploy the first rack from the first stowed position to the first deployed position.

In various embodiments, the first deployed position may not be a fully deployed position of the first rack. In some embodiments, the second rack may be positioned below the first rack. In various embodiments, the first rack may include a first member and the second rack includes a second member, wherein the second member of the second rack releasably engages the first member when the second rack is in the second deployed position and the first rack is in the first stowed position. In some embodiments, the first member of the first rack may be positioned adjacent a front side of the first rack and the second member of the second rack may be positioned adjacent a back side of the second rack. In various embodiments, the second member may be disengaged from the first member when the second rack is in the second stowed position and the first rack is in the first stowed position. In some embodiments, the second member may be a hook shaped member and the first member may be a loop shaped member.

In addition, in various embodiments, a dish washing appliance may include a dishwasher tub having a front opening. In some embodiments, the appliance may include a first rack engaging the dishwasher tub, wherein the first rack may be positionable between a first stowed position in the dishwasher tub and a first deployed position different from the first stowed position. In some embodiments, the appliance may include a second rack engaging the dishwasher tub, wherein the second rack may be positionable between a second stowed position in the dishwasher tub, a second deployed position different from the second stowed position, and a third deployed position further deployed from the second deployed position. In various embodiments, the first rack may include a first member and the second rack may include a second member, wherein the second member of the second rack may releasably engage the first member when the second rack is in the second deployed position and the first rack is in the first stowed position to deploy the first rack from the first stowed position to the first deployed position.

In various embodiments, the first deployed position may not be a fully deployed position of the first rack. In some embodiments, the first member of the first rack may be positioned adjacent a front side of the first rack and the second member of the second rack may be positioned adjacent a back side of the second rack. In various embodiments, the second member may be disengaged from the first member when the second rack is in the second stowed position and the first rack is in the first stowed position. In some embodiments, at least one of the second member and the first member may be a hook shaped member, and wherein the other of the second member and the first member may be a loop shaped member. In various embodiments, the first rack may be fixed relative to the dishwasher tub and the second rack may be adjustable in height. In some embodiments, the first member may project downwardly from the first rack and the second member may project upwardly from the second rack. In various embodiments, when the second rack deploys further from the second deployed position to a third deployed position the second rack actuates the first rack from the first stowed position to the first deployed position.

In addition, in some embodiments, a method of deploying a dishwasher rack within a dish washing appliance may include providing a dishwasher tub. In various embodiments, the method may include providing a first rack engaging the dishwasher tub, wherein the first rack may be positionable between a first stowed position in the dishwasher tub and a first deployed position different from the first stowed position, and wherein the first rack may include a first member. In some embodiments, the method may include providing a second rack engaging the dishwasher tub, wherein the second rack may be positionable between a second stowed position in the dishwasher tub and a second deployed position different from the second stowed position, and wherein the second rack may include a second member. In various embodiments, the method may include deploying the second rack from the second stowed position to the second deployed position. In some embodiments, the method may include releasably engaging the first member with the second member when the first rack is in the first stowed position and the second rack is in the second deployed position. In various embodiments, the method may include deploying the first rack from the first stowed position to the first deployed position after deploying the second rack from the second stowed position to the second deployed position.

In various embodiments, the method may include deploying the first rack to a first fully deployed position further from the first stowed position than the first deployed position. In some embodiments, the method may include reducing a distance between the first member and the second member in a horizontal direction. In various embodiments, the method may include disengaging the first member from the second member. In some embodiments, the method may include deploying the first rack away from the first deployed position, and increasing a distance between the first member and the second member. In various embodiments, the method may include deploying the second rack to a second fully deployed position, wherein the first rack is in the first deployed position when the second rack is in the second fully deployed position.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
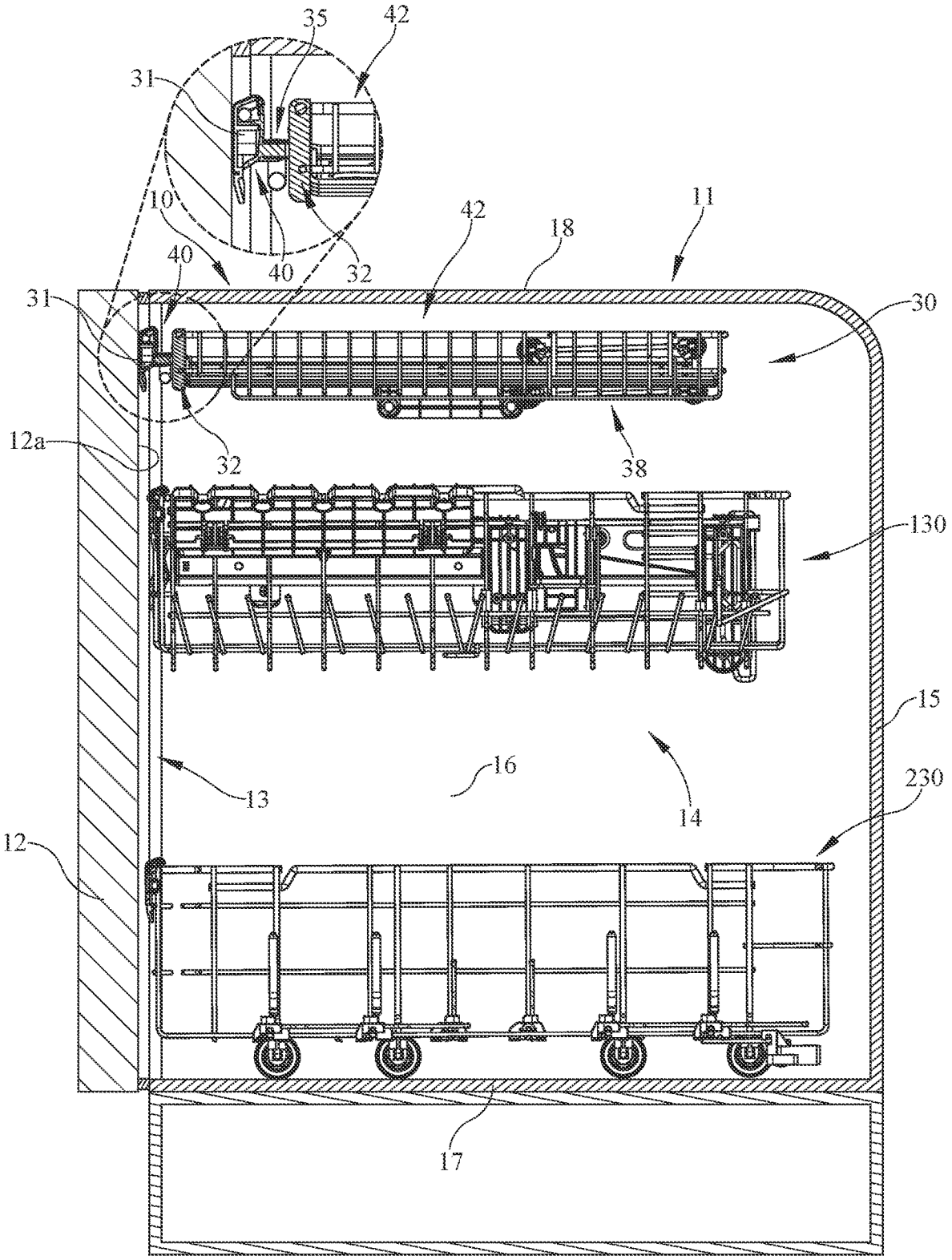
FIG. 1 is a side sectional view of one embodiment of an upper/third retractable dishwasher rack illustrating the rack in a stowed position within a dishwasher tub and a rack handle in the stowed position relative to the remaining portion of the rack.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing or dishwasher appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments.

Embodiments for a dish washing appliance 10 are shown herein for ease of understanding. For example, a front-load dish washing appliance that includes a front-mounted door 12 in a cabinet or housing 11 that provides access to one or more horizontally-oriented dishwasher racks 30, 130, 230 housed within the cabinet or housing 11 may be used. More specifically, the dishwasher rack 30, 130, 230 may engage and/or be housed (e.g. slidably) in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dish washing appliance.

Figure 5:
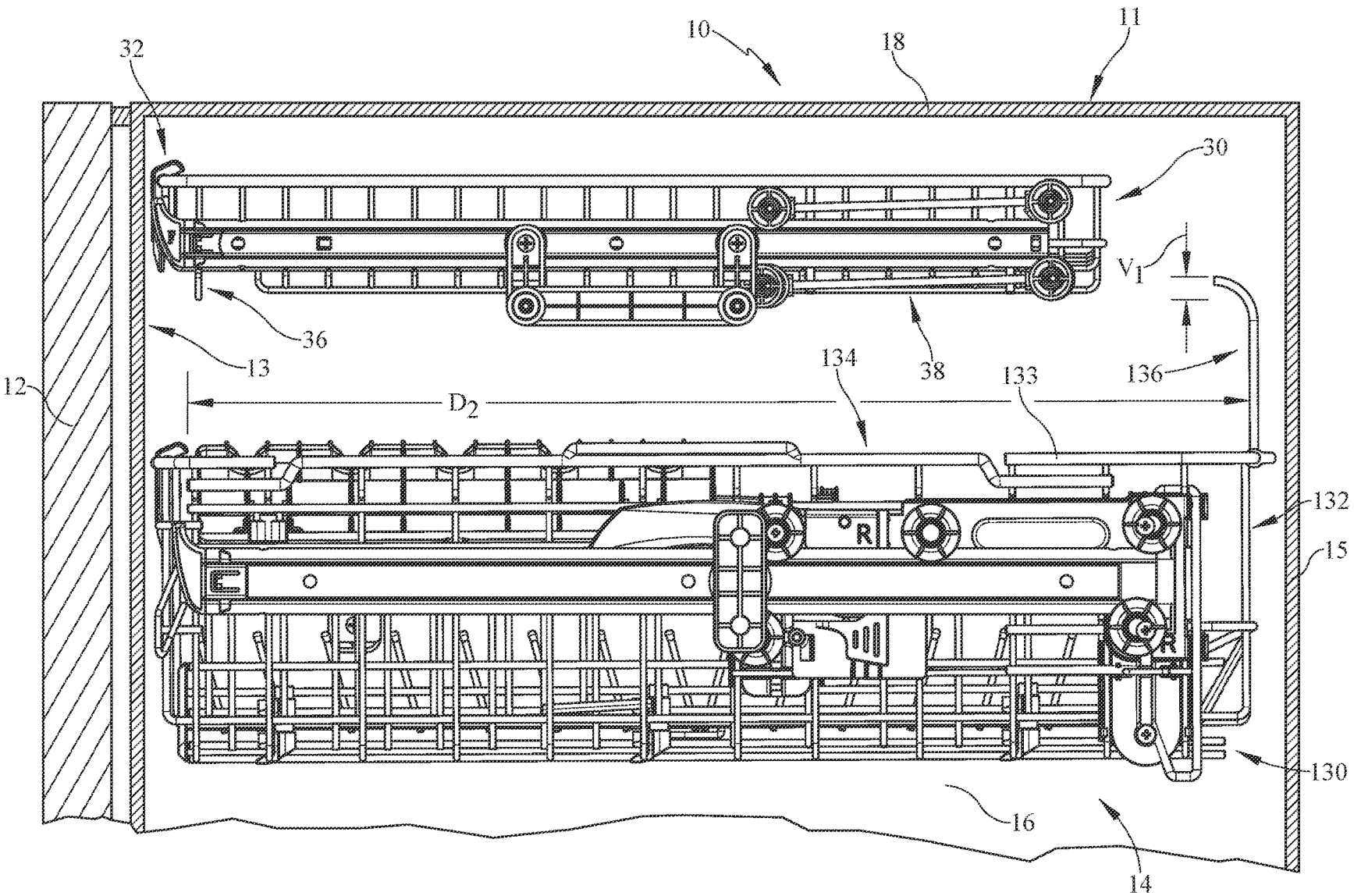
FIG. 5 is a side view of another embodiment of an upper/third retractable dishwasher rack illustrating the upper rack and the adjacent rack in a stowed position within a dishwasher tub, and members of each rack disengaged from each other.
Figure 10:
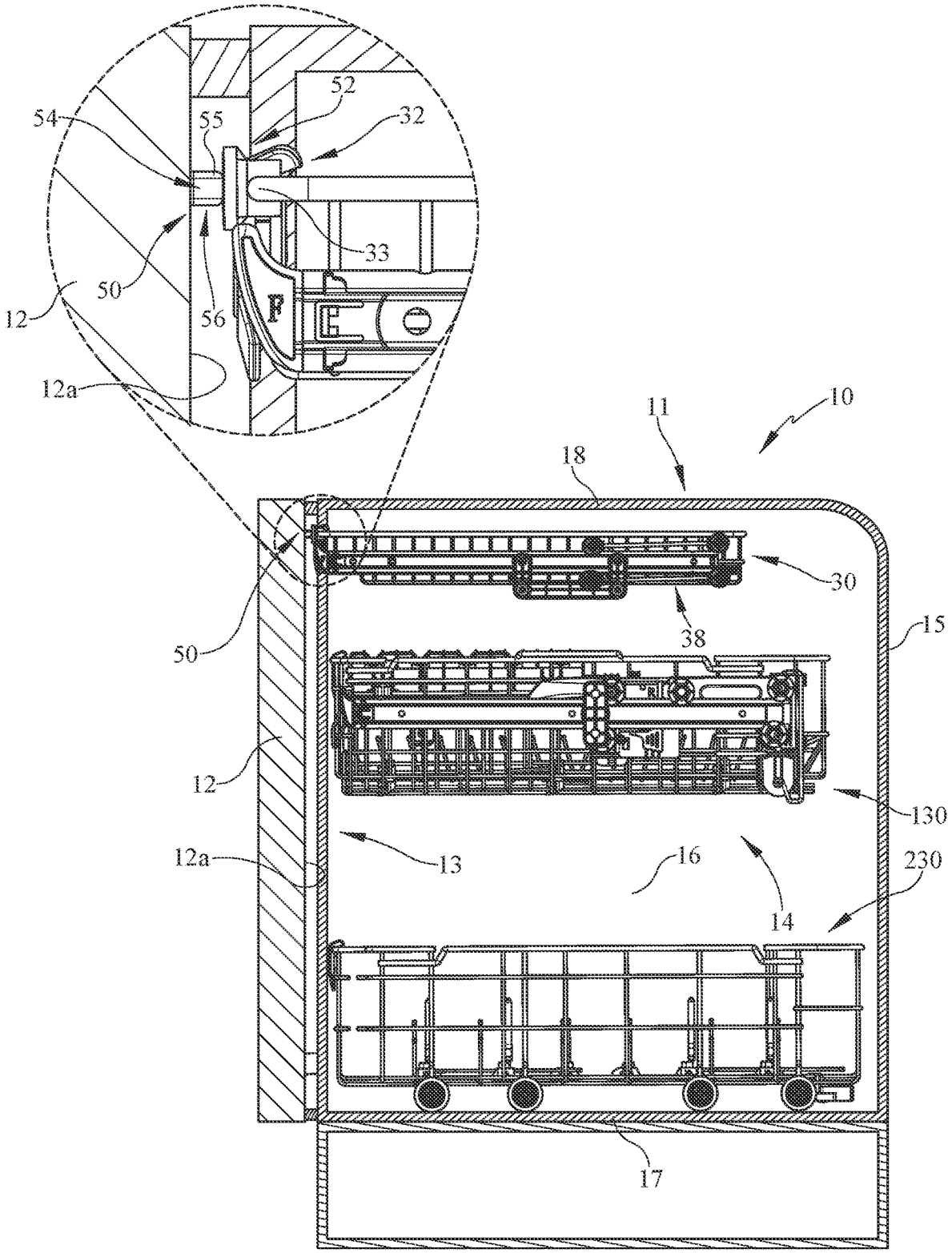
FIG. 10 is a side view of another embodiment of an upper/third retractable dishwasher rack illustrating the rack in a stowed position within a dishwasher tub and the rack and the door magnetically engaged to each other.

Turning now to the drawings, wherein like numbers denote like parts throughout the several views, FIGS. 1-13 illustrates an example dish washing appliance 10 in which the various technologies and techniques described herein may be implemented. Dish washing appliance 10 is a front-load dish washing machine, and as such may include a front-mounted door 12 (e.g. hinged) defining an opening 13 that provides access to a horizontally-oriented dishwasher tub 14. The tub 14 may be defined by at least a rear wall 15 interconnected by two opposing side walls 16, bottom wall 17, and a top wall 18. The door 12 may be coupled with the cabinet or housing 11 that may house the dishwasher tub 14 in some embodiments. Door 12 is generally hinged (e.g. hinge 19) along a front or front edge of the housing 11 adjacent the opening 13/bottom wall 17 and is pivotable between the closed position illustrated in FIGS. 1, 5, and 10 and an open position FIGS. 2, 3, 6-8, and 11-13. When door 12 is in the open position, dishes, utensils, pans, and other washable items may be inserted into and removed from the one or more dishwasher racks 30, 130, 230 through the opening 13 in the front of cabinet or housing 11. Control over dish washing appliance 10 by a user is generally managed through a control panel (not shown) disposed on a door 12 and implementing a user interface, and it will be appreciated that in different dish washing machine designs, control panel may include various types of input and/or output devices, including various knobs, buttons, lights, switches, textual and/or graphical displays, touch screens, etc. through which a user may configure one or more settings and start and stop the wash cycle as described herein. For example, the control panel, or portions thereof, may be included with the dishwasher rack, on the interior or exterior of the door, and/or adjacent the rack within the opening of the dish washing machine. For example, in some embodiments, portions of the controls may be accessible when the door is in the open position.

As shown in the Figures, the one or more dishwasher racks 30, 130, 230, or portions thereof, may be positionable/actuated relative to the dish washing appliance 10 between a stowed or un-deployed position (FIGS. 1, 5, 10) and a deployed or different position (FIGS. 2, 3, 7, 8, 11, 12). At least one of the stowed positions of the dishwasher rack 30, 130, 230 may be used when one or more of the washing cycles is in operation. In use, the deployed position may be one or more horizontal positions different from one or more of the stowed positions. One or more deployed positions may be a horizontal position to dry, load, and/or unload dishes, utensils, exhibit the rack, or portions thereof, or the like. For example, one deployed position or partially opened position of the rack may be a position (e.g. an exhibiting position, FIGS. 7 and/or 11) other than when the rack is in its fully extended position (FIGS. 3, 8, 12) out of the dishwasher tub 14 or opening 13. Further in another example, one deployed position of a portion 40 of rack (e.g. handle 31) may be a position (e.g. an exhibiting position, FIG. 2) when the remaining portion 42 of the rack is in a stowed or fully stowed position (FIG. 2) and/or deployed position (FIG. 3) relative to the dishwasher tub 14. The one or more dishwasher racks 30, 130, 230, or portions thereof, may travel in a substantially horizontal plane. The horizontal plane may be into and/or out of the dishwasher tub 14 or cavity. Although the substantially linear movement of the dishwasher rack cycle may occur along the horizontal plane in a variety of heights as shown, the linear travel may be in a variety of angles in one or both the directions into or out of a position.

Figure 2:
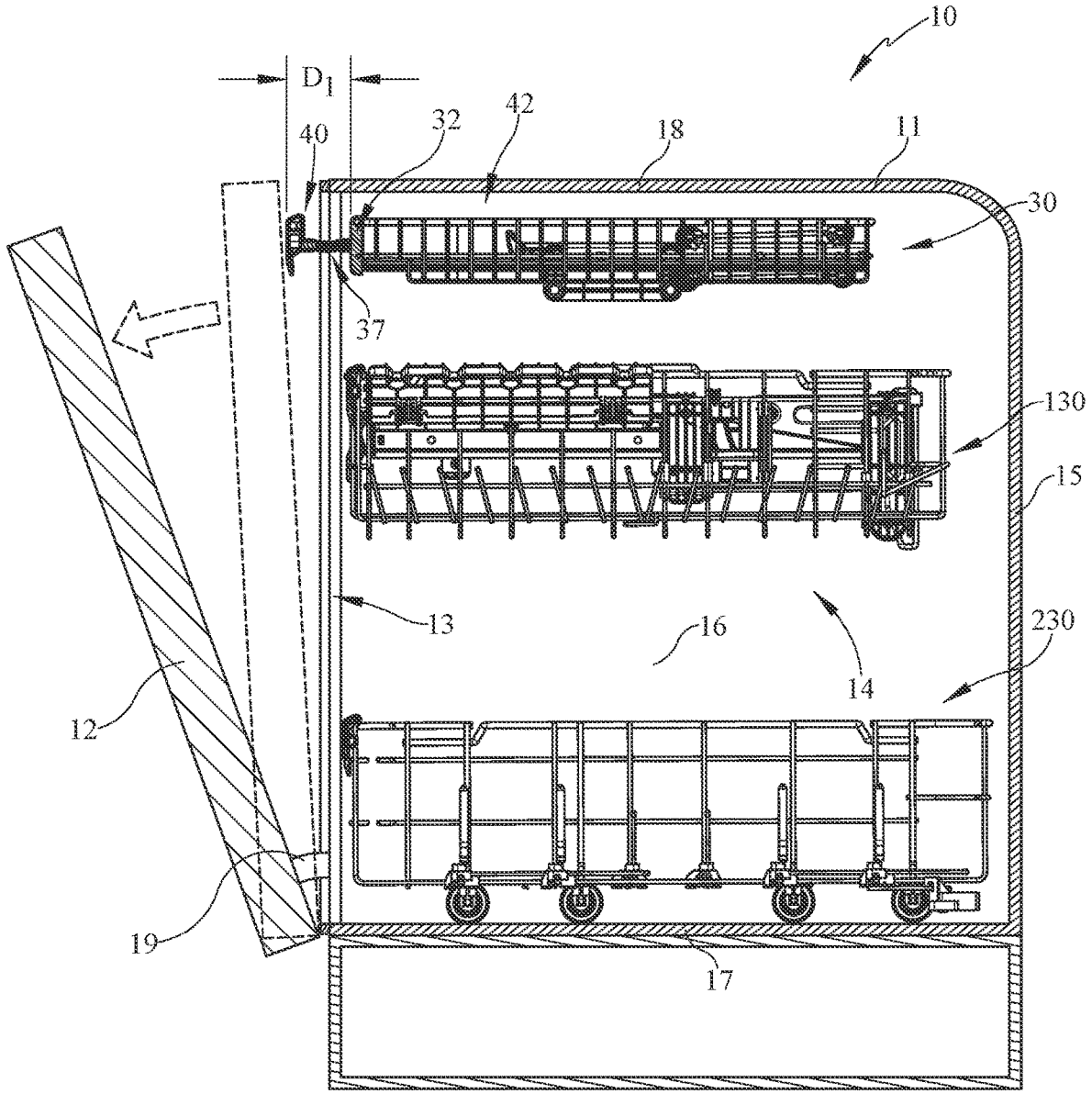
FIG. 2 is a side sectional view of the embodiment of an upper/third retractable dishwasher rack in FIG. 1 illustrating the rack in a stowed position and the opening door actuating the rack handle to a deployed position relative to the remaining portion of the rack.
Figure 3:
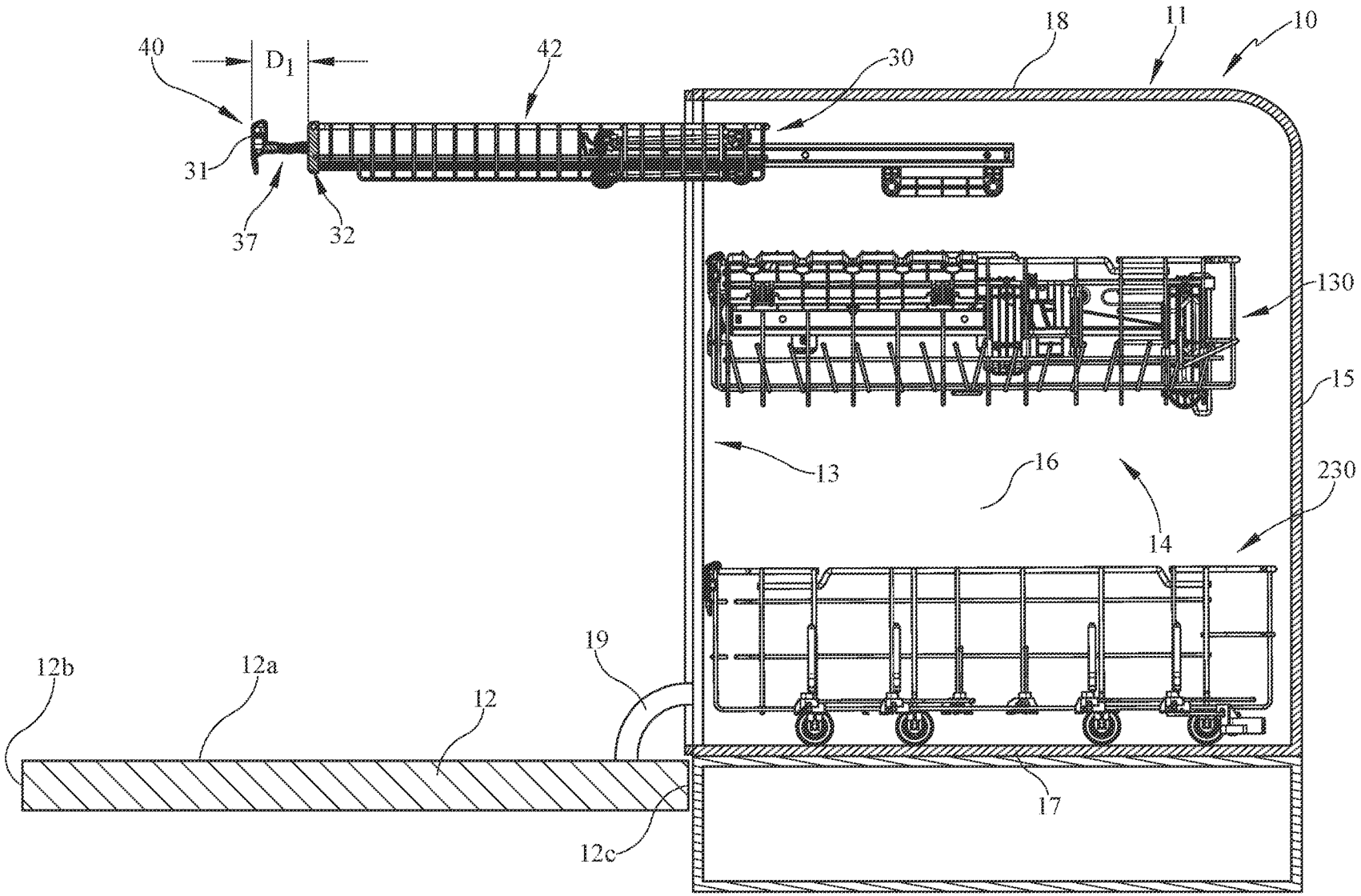
FIG. 3 is a side sectional view of the embodiment of an upper/third retractable dishwasher rack in FIG. 1 illustrating the rack and the handle in a deployed position relative to the tub and the rack handle in the deployed position relative to the remaining portion of the rack.
Figure 4:
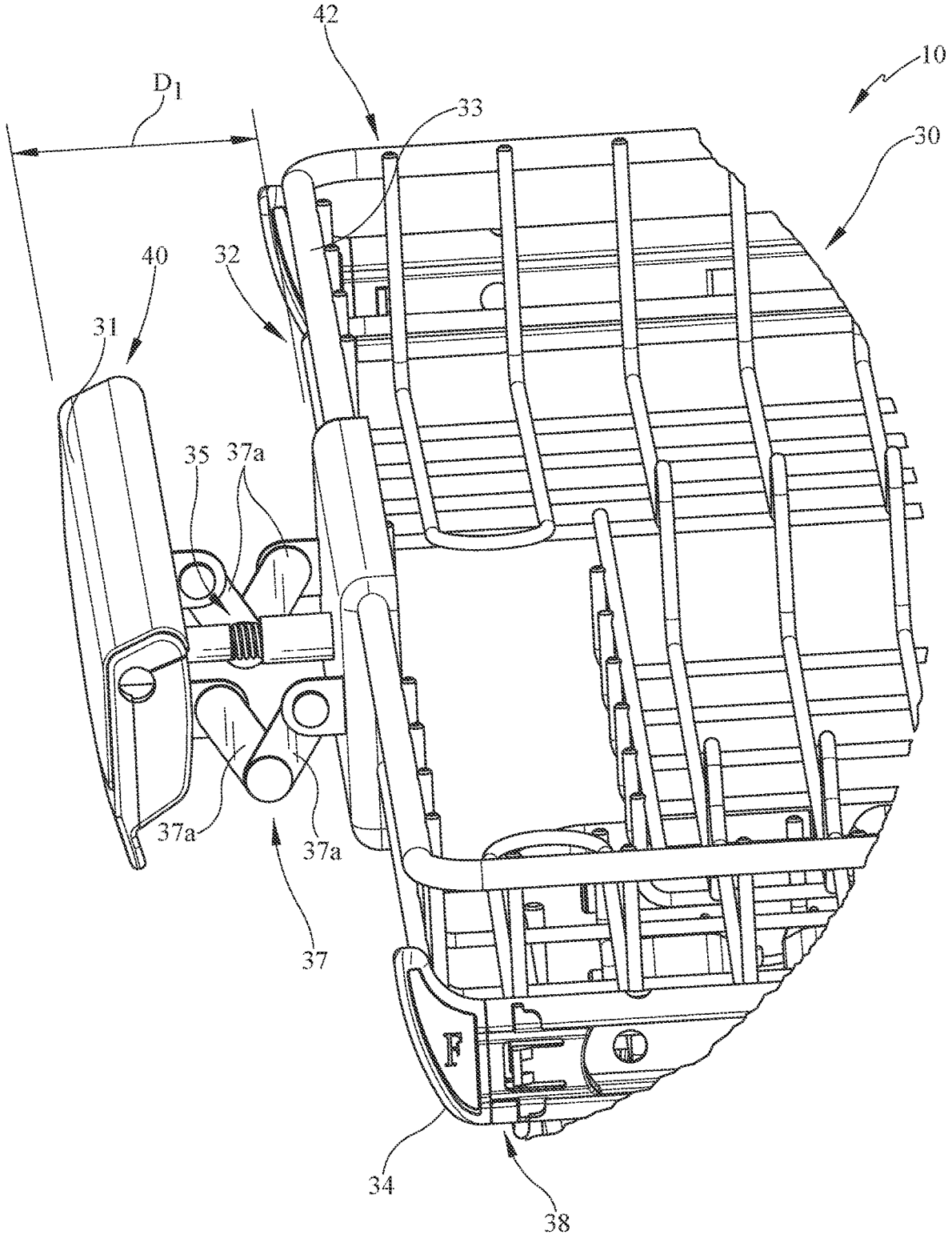
FIG. 4 is a perspective view of the rack of FIG. 2 illustrating the rack handle in the deployed position relative to the remaining portion of the rack.
Figure 6:
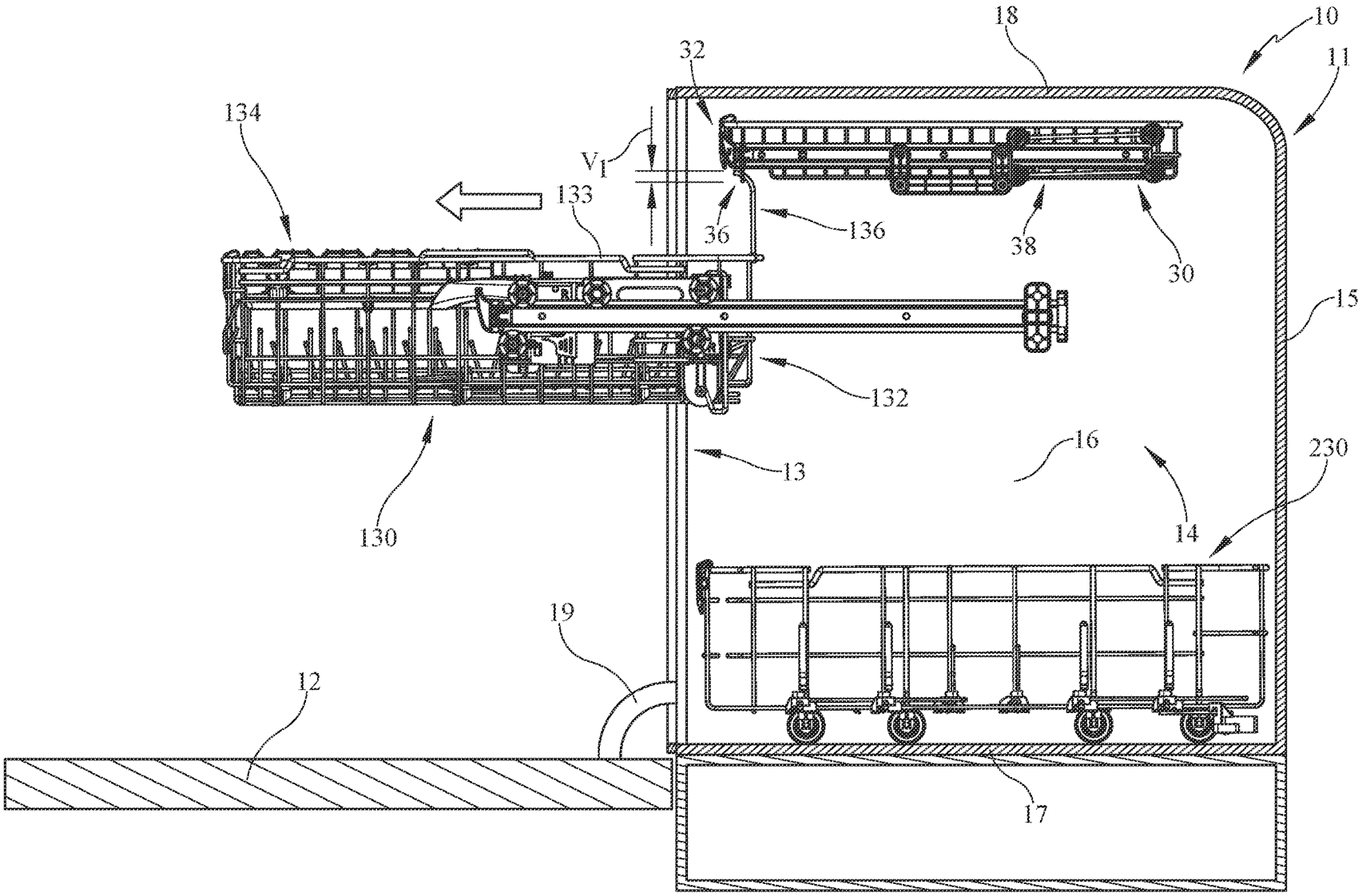
FIG. 6 is a side view of the embodiment of an upper/third retractable dishwasher rack in FIG. 5 illustrating the upper rack in a stowed position and the adjacent rack in a deployed position, and members of each rack engaged with each other.
Figure 7:
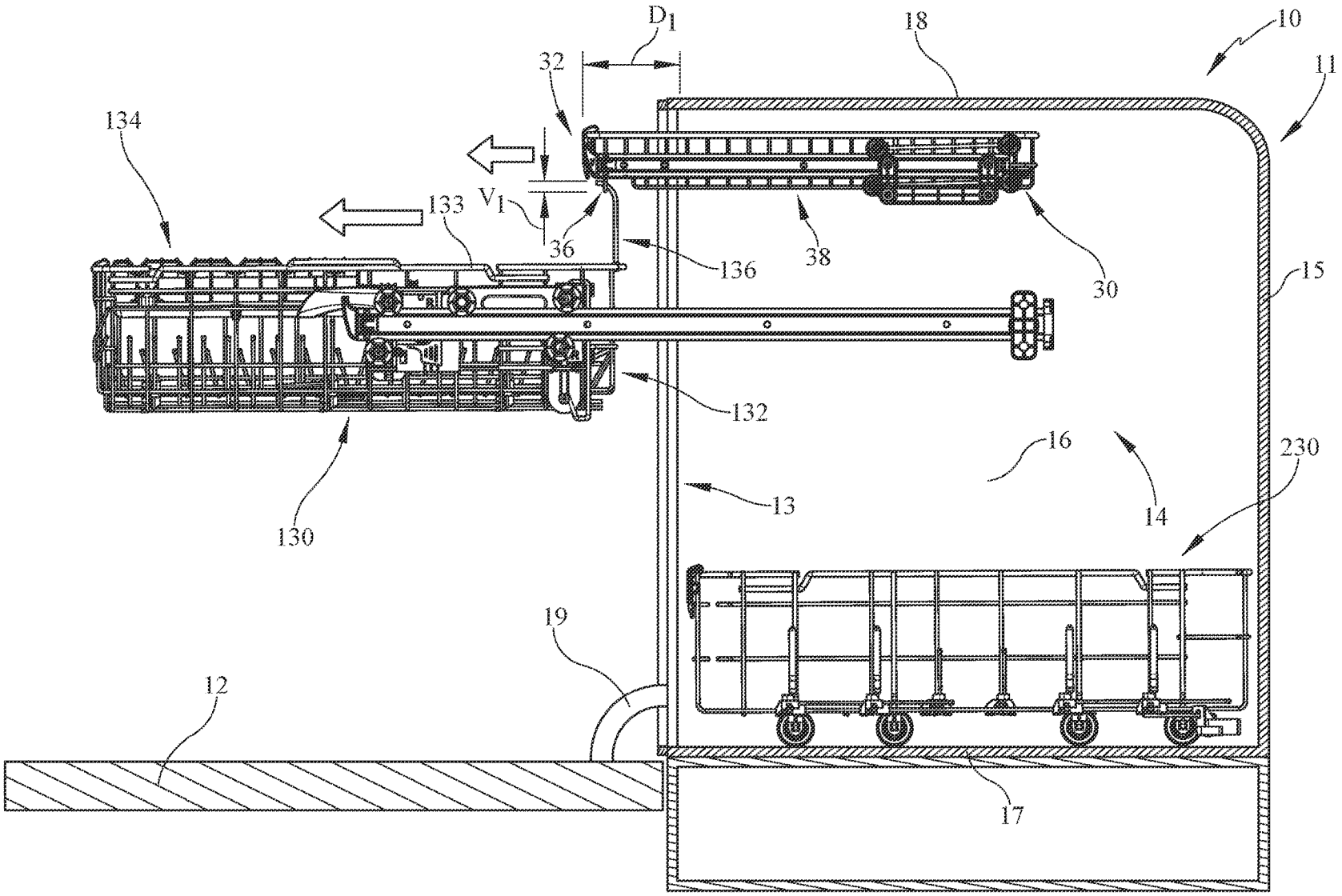
FIG. 7 is a side view of the embodiment of an upper/third retractable dishwasher rack in FIG. 6 illustrating the adjacent rack in a further deployed position thereby actuating the upper rack to a deployed position relative to the tub, and members of each rack engaged with each other.
Figure 8:
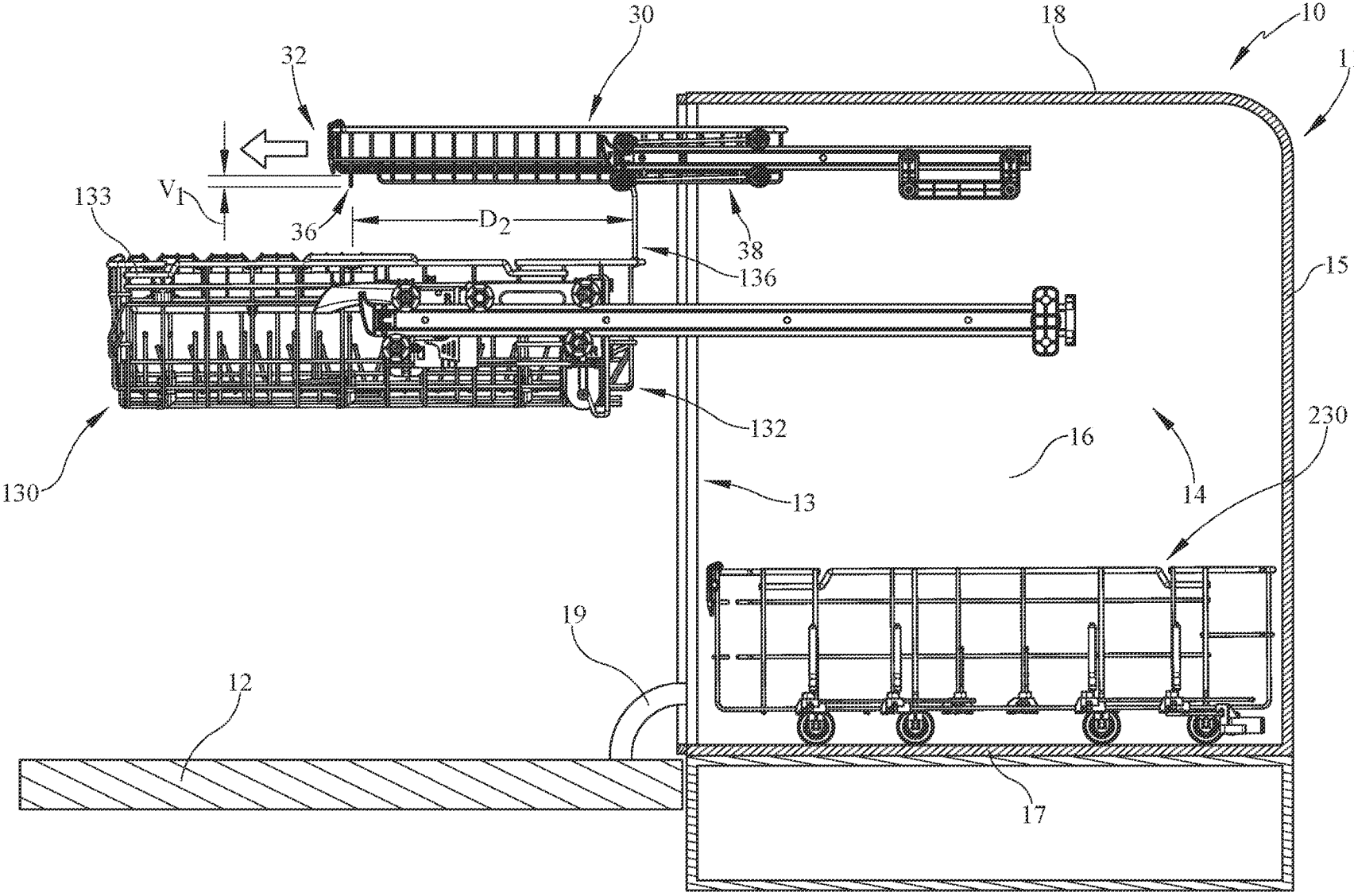
FIG. 8 is a side view of the embodiment of an upper/third retractable dishwasher rack in FIG. 7 illustrating the upper rack deployed to a further deployed position relative to the tub, and members of each rack disengaged from each other.
Figure 9:
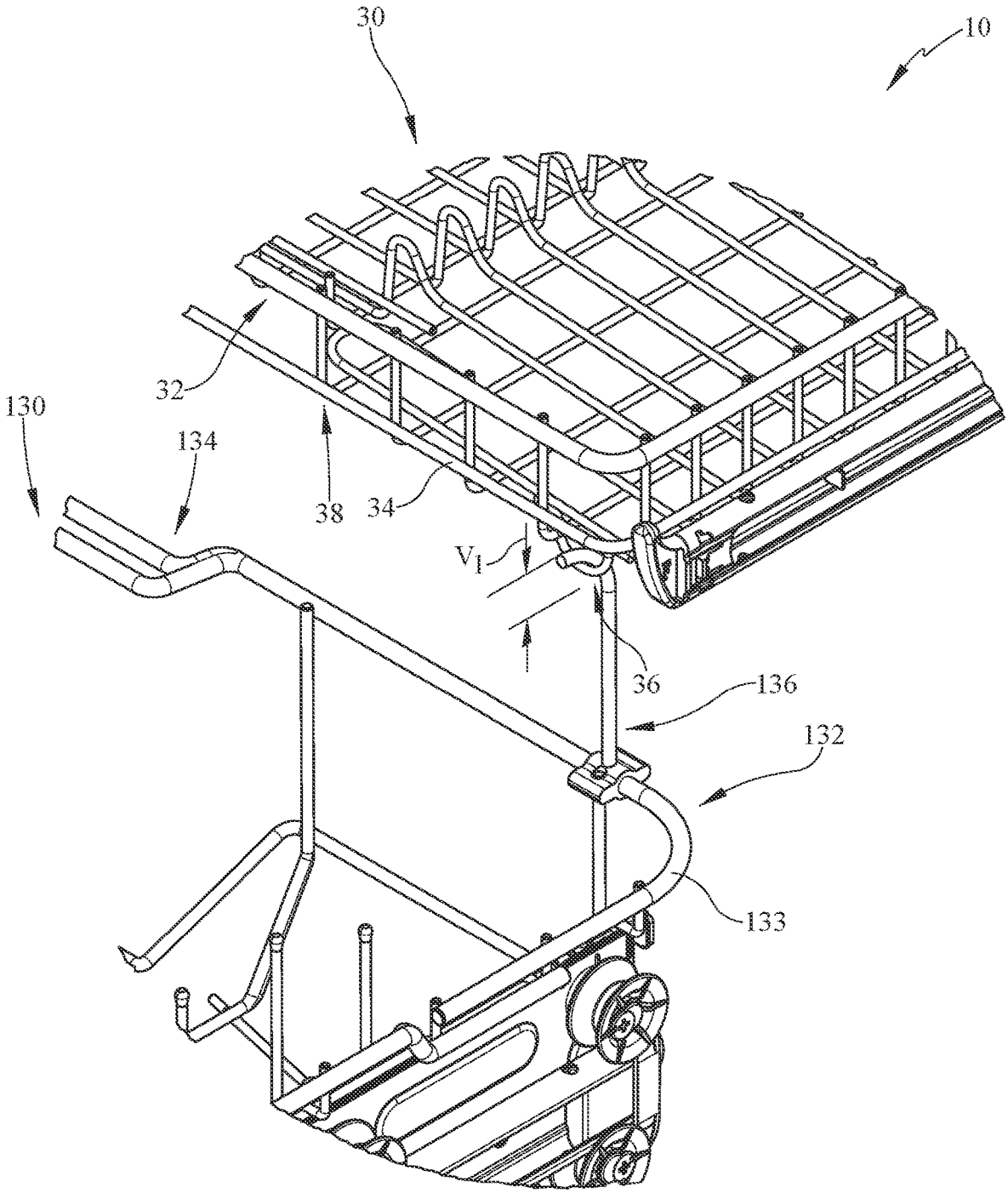
FIG. 9 is a perspective view of the upper rack and adjacent rack of FIGS. 6 and 7 illustrating the members of each rack engaged with each other.
Figure 11:
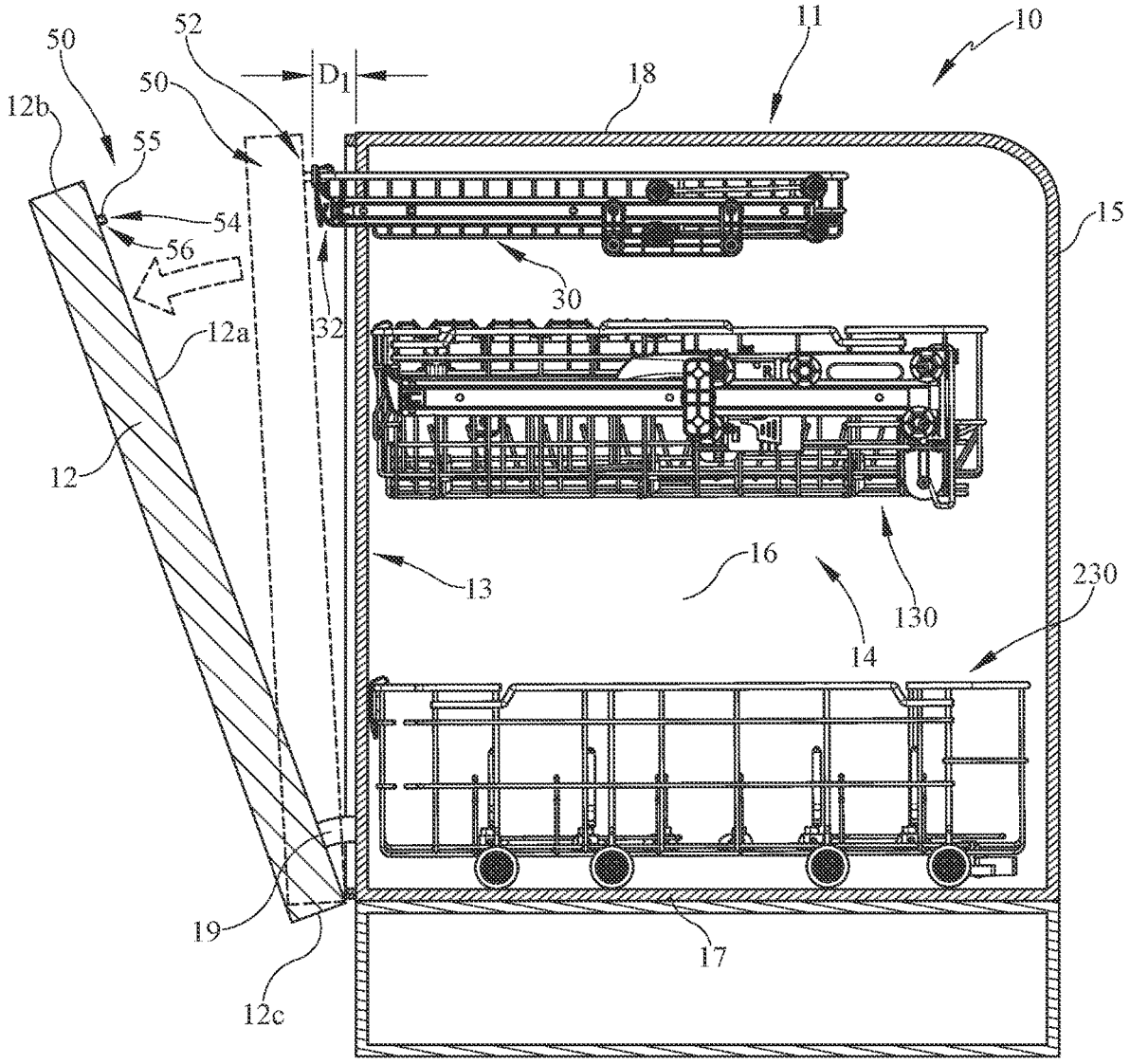
FIG. 11 is a side view of the embodiment of an upper/third retractable dishwasher rack of FIG. 10 illustrating the opening door actuating the rack to a deployed position relative to the dishwasher tub while magnetically engaged to each other, and wherein further opening of the door magnetically disengages the door from the rack.
Figure 12:
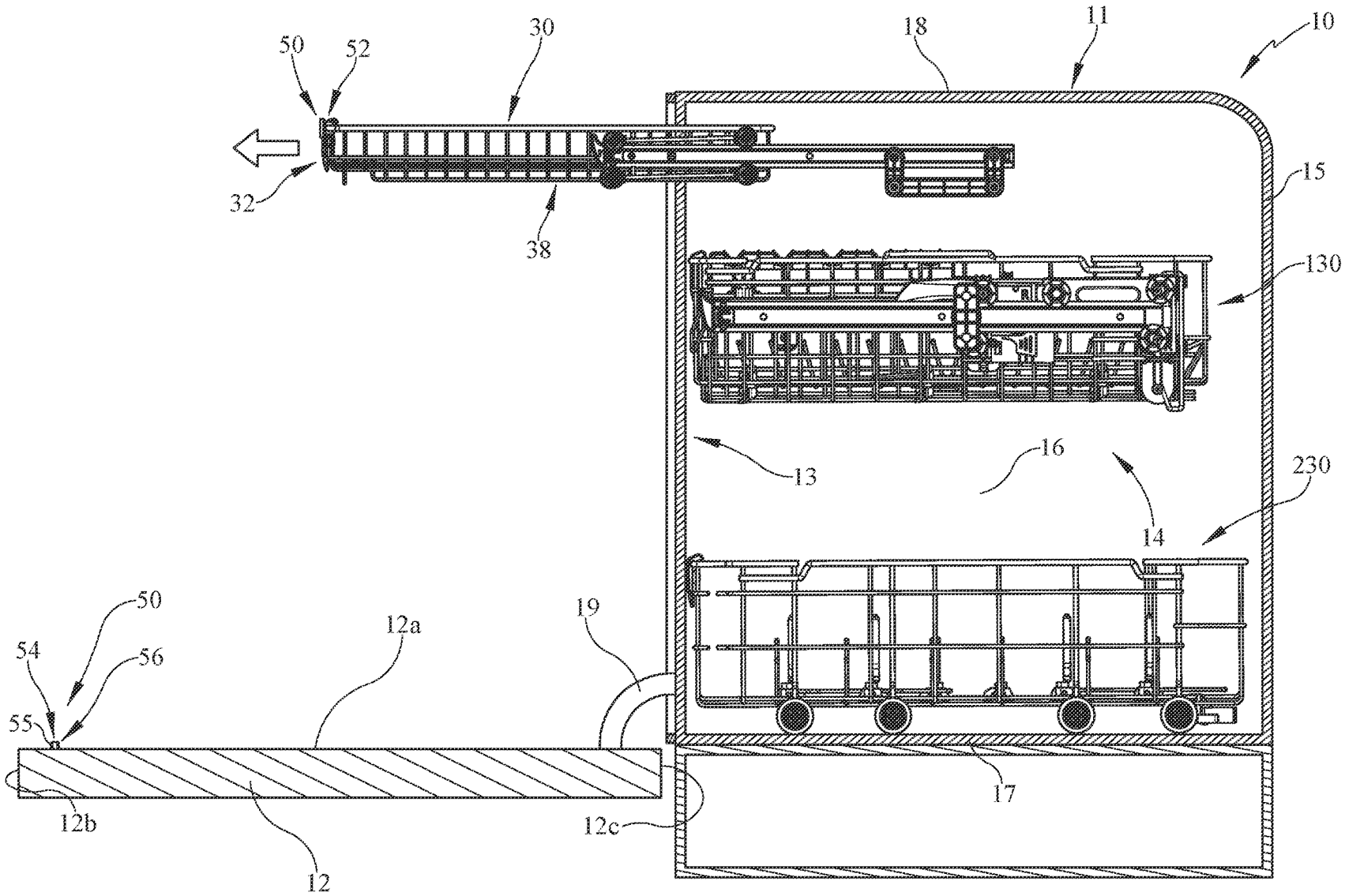
FIG. 12 is a side view of the embodiment of an upper/third retractable dishwasher rack in FIG. 11 illustrating the upper rack deployed to a further deployed position relative to the tub, and the door magnetically disengaged from the rack.

As illustrated in the Figures, at least one rack 30, or portions thereof, may be exhibited or presence made aware to the user to access (e.g. unload/load) the contents therein and/or adjust (e.g. deploy/stow) the rack. The rack 30, or portions thereof, may be deployed or project from the opening 13 (e.g. at a first deployed position, at an exhibiting position, away from the stowed position) to be visible and/or engageable by the user (e.g. by hand). The rack 30, or portions thereof, may be actuated and/or carried (e.g. pulled, pushed, forced, and/or releasably engaged) to at least one deployed position (e.g. first deployed position, non-fully deployed, exhibiting position) by manually operating another structure or portion of the appliance. The rack 30, or portions thereof, may be releasably disengaged or separate from the actuating structure upon reaching at least one deployed position. For example, the user may not have to manually/directly engage the rack 30, or portions thereof (e.g. 40, 31), to be deployed/exhibited towards the user and/or through the opening 13. For example, the door 12, adjacent rack 130, or portion of the rack/appliance may actuate the deployment of the rack 30, or portions 40 thereof. The rack 30, or portions 40 thereof, may be deployed or project from the rack/remaining portion 30/42, or portion thereof, for a distance(s) (e.g. first distance D1) when actuated. When the presence of the rack 30, or portions 40 thereof, has been actuated, the deployed position (e.g. first deployed position, exhibiting position) of the rack 30, or portions 40 thereof, may not be a fully deployed position of the rack. For example as shown in FIG. 2, the remaining portion 42 of the rack 30 may remain in the stowed position (e.g. first stowed position, FIGS. 1 and 2) while a rack portion 40 (e.g. first portion) projects the first distance D1 or away from the remaining portion 42 of the rack 30. Moreover, in some embodiments as shown in FIGS. 7 and 11, the entire rack 30 may be deployed for the first distance D1 (e.g. distance shorter than the fully deployed position, non-fully deployed distance) away from the stowed position (e.g. first stowed position, FIGS. 5, 6, and 10). Although not shown, when actuated the rack 30 may deploy to the fully deployed position. When the rack, or portions thereof, is in the deployed position (e.g. first), the rack, or portions thereof, may be continued to be deployed and/or stowed in one or more directions (e.g. horizontal). For example, the user (e.g. directly, manually, by hand, different from the initial deployment, etc.) may continue to deploy and/or stow the rack, or portions thereof. In some embodiments, the door, adjacent rack, or portion of the rack/appliance may stow the rack, or portions thereof. In addition, in some embodiments, the door 12, adjacent rack 130, and/or portion of the rack/appliance that actuates the rack 30 may continue to a fully deployed position, open position, and/or position different from when the rack 30 (e.g. in the first deployed position) is released/separated therefrom. For example as shown in FIG. 11, the door 12, if used to actuate the rack, or portions thereof, may release or separate from the rack 30 (e.g. when the rack is in the first deployed position) when continuing to open the door 12 towards the fully open position (FIG. 12). Further, for example as shown in FIG. 2, the door 12, if used to actuate first portions 40 of the rack from the remaining portion 42 of the rack 30, may release or separate from the rack 30, or portions thereof, (e.g. when the remaining portion 42 of the rack is in the stowed position) when continuing to open the door 12 towards the fully open position (FIG. 3). Moreover, for example as shown in FIG. 7, the second rack 130, if used to actuate the first rack 30, or portions thereof, may release or separate from the rack 30 (e.g. when the rack 30 is in the first deployed position) when continuing to further deploy the rack 30 to the second/further or fully deployed position (FIG. 8).

Method and Apparatus for Actuating a Portion of a Dishwasher Rack

In some implementations, the user may be presented with a portion 40 (e.g. first portion) of the rack 30 in a deployed position when the rack 30 (e.g. remaining portion 42) is in a stowed position. The rack 30 may be adjacent the top wall 18 of the dishwasher tub 14 in the one embodiment as shown. As shown in FIGS. 1-4, the one or more first portions 40 of the rack 30 deploying from the remaining portion 42 of the rack 30 may include one or more handles 31. The handle 31 may be adjacent to a front side 32 of the rack 30 when in the stowed position (see FIG. 1) and distal therefrom in the deployed position (see FIGS. 2-4). Although the handle 31 is shown in the Figures as deploying/stowing relative to the remaining portion 42, it should be understood that the first portion 40 of the rack 30 may be a variety of structures or portions of the rack 30. For example, the first portion 40 may be the front side 32, top edge 33, and/or bottom edge 34 of the rack, or portions thereof. Moreover, the first portion 40 may not include a handle 31 in some embodiments. The first portion 40 may be positioned between a stowed position (e.g. second stowed position) with the remaining portion 42 of the rack 30 (e.g. first stowed position, first deployed position, etc.) and a deployed position (e.g. second deployed position, exhibiting position) with the remaining portion 42 of the rack 30 different from the stowed position (e.g. second stowed position). When the rack 30 (e.g. remaining portion 42) is in the first stowed position, the first portion 40 may be positioned through the front opening 13 away from the dishwasher tub 14 when in the second deployed or exhibiting position (see FIG. 2) and positioned within the tub or recessed within the front opening 13 when in the second stowed position (see FIG. 1). The first rack 30 (e.g. first portion and remaining portion) may be positioned to a first deployed position (see FIG. 3) when the first portion 40 (e.g. handle 31) is in the second deployed position. The first portion 40 (e.g. handle 31) may be positionable in the second stowed position and the second deployed position when the rack 30 (e.g. remaining portion and first portion) is in the first stowed position and/or the first deployed position.

In some implementations, the dish washing appliance 10, handle 31, and/or rack 30 may include one or more biasing mechanisms 35. The biasing mechanism 35, if used, may bias the first portion 40 (e.g. handle 31) between the second stowed/deployed positions relative to the remaining portion 42 of the rack 30. The one or more biasing mechanisms 35 as shown in the one embodiment in FIGS. 1-4 urges the first portion 40 (e.g. handle) towards the second deployed position relative to the remaining portion 42 of the rack (e.g. stowed position). The urging of the handle 31 may be in the direction towards the front opening 13 of the dishwasher tub 14 or away from the remaining portion 42. The first portion 40 (e.g. handle) may travel in at least a linearly direction between the second stowed position and second deployed relative to the rack 30 for at least one first distance D1. Although the first portion 40 may travel in a linear path, it should be understood that the first portion may travel in a variety of directions when deploying/stowing relative to the remaining portion. For example, the handle 31 may travel in a linear direction, upwardly, downwardly, and/or arcuate direction in various embodiments. Although the biasing mechanism 35 may be a compression spring as shown in the Figures, it should be understood that the biasing mechanism may be a variety of sizes, shapes, quantities, and constructions and still be within the scope of the invention.

In some implementations, the door 12 and/or appliance 10, or portions thereof, may actuate the first portion 40 to deploy and/or stow relative to the remaining portion 42 of the rack 30. The door 12 may actuate/stow the rack 30 (e.g. the remaining portion 42 and the first portion 40) from the first deployed position (see FIG. 3) to the first stowed position (see FIG. 1). The door 12 may actuate (e.g. deploy and/or stow) the first portion 40 (e.g. handle 31) between the second deployed position (See FIG. 2) and the second stowed position (see FIG. 1) when operating (e.g. opening, closing) the door 12. In the embodiment shown in FIGS. 1-3, when the door 12 opens from the closed position to at least one of the open positions, the door 12 actuates the first portion 40 from the second stowed position to the second deployed position (e.g. when the remaining portion of the rack is in the first stowed position). When opening the door 12 from the closed position, the first portion 40 or handle 31 is tensioned/biased against and/or maintains a releasable engagement against the door 12 until the door separates/releases/disengages from the first portion 40 upon further door movement/pivoting. When opening the door 12, the force (e.g. compression, spring, tension) of the one or more biasing mechanisms 35 decreases as the first portion 40 (e.g. handle) travels from the from the second stowed position to the second deployed position. When the first portion 40 reaches its fully deployed or second deployed position relative to the remaining portion 42, the force of the biasing mechanism 35 may no longer decrease and/or the door may continue to an open position further from the closed position or to the fully open position (e.g. without contact with the first portion, after separation or disengaging the door from the first portion). When closing the door 12 from the open position, the door 12 is engaged to and/or engages the first portion 40 in at least one position of the rack (e.g. remaining portions deployed or stowed position with the first portion) and the force (e.g. compression, spring, tension) of the one or more biasing mechanisms increase as the first portion 40 (e.g. handle) travels from the from the second deployed position to the second stowed position with the engagement and/or force applied from the closing door.

In some implementations, the appliance and/or rack may include one or more attachment mechanisms 37 between the first portion 40 (e.g. handle) and the remaining portion 42 (e.g. basket, slides, rails). The one or more attachment mechanisms 37 may allow travel between the second stowed position and the second deployed position in one or more distances (e.g. first distance D1), directions, and/or orientations relative to each other. The direction(s) and/or orientation(s) of the first portion's travel may be the same or different when deploying and/or stowing the first portion 40 relative to the remaining portion 42. The one or more attachment mechanisms 37 may be one or more linkage members 37*a* interconnecting the first portion 40/handle 31 and the remaining portion 42 of the rack 30 (e.g. front side of the rack). The one or more linkage members 37*a* may allow the handle 31 to travel between the second stowed position and the second deployed position. The linkage 37*a* may define the direction and/or distance that the first portion/handle may travel when deploying/stowing relative to the remaining portion 42 of the rack. Although the attachment mechanism 37 is shown as one or more linkages 37*a* in the Figures, it should be understood that the attachment mechanism may be a variety of shapes, sizes, quantities, and constructions to allow for relative movement between the first portion and the remaining portion of the rack. For example, one or more pin-and-slot engagements may be used between the first portion and the remaining portion of the rack. Further, for example, a telescoping engagement and/or slide/rail engagement may be used between the first portion and the remaining portion of the rack. Moreover, for example, a hinge mechanism may be used in some embodiments.

Method and Apparatus for Actuating a Dishwasher Rack

In some implementations, the user may be presented with a rack 30 in a deployed position. The deployed position of the presented rack may be at least one position (e.g. exhibiting position, FIGS. 7 and 11) between a fully deployed position and the stowed position. The rack 30 may be adjacent the top wall 18 of the dishwasher tub 14 in some embodiments as shown. The rack 30 may be actuated (e.g. deployed/stowed) by one or more portions of the appliance 10 (e.g. door, rack, adjacent rack, etc.). In some embodiments, the rack 30 may be actuated (e.g. deployed and/or stowed) by at least one of the door and an adjacent rack. Once the rack is in the deployed/exhibiting position, the user may become aware of the presence of the rack 30 and subsequently leave the rack in the current position (e.g. load/unload), continue to further deploy the rack to another deployed or fully deployed position (e.g. load/unload), and/or stow the rack towards the stowed position. When the rack 30 is actuated to the deployed position as shown in FIGS. 7 and 11, the rack 30 may not further be deployed by the appliance, or portions thereof, (e.g. door 12, adjacent rack 130). As a result, the user may manually have to continue to deploy the rack to another deployed or fully deployed position as shown in FIGS. 8 and 12 (e.g. to load/unload). The rack 30 may not further be deployed from the deployed position because the appliance, or portions thereof, (e.g. door) may disengage/separate/release from the deployed rack. Further, the appliance, or portions thereof, (e.g. adjacent track 130) reached its own fully deployed position and cannot further actuate (e.g. push, pull, carry, engage, etc.) the rack 30 past the deployed/exhibiting position. The user and/or the appliance, or portions thereof, (e.g. door, adjacent rack) may be used to stow the rack 30 towards or to the stowed position.

In some implementations, another rack 130 (e.g. second rack) and/or appliance 10, or portions thereof, may actuate the rack 30 (e.g. first rack) to at least one deployed position (e.g. not the fully deployed position, fully deployed position, exhibiting position). In the one embodiment shown in FIGS. 5-9, the second rack 130/appliance 10 may actuate the first rack 30 (e.g. adjacent rack, third/upper rack). The racks 30, 130 may releasably engage/disengage from each other during operation (e.g. during stowing/deploying of the first/second rack). The second rack 130 may carry, pull, actuate, push, deploy, stow, and/or transport the first rack 30 for one or more distances (e.g. first distance D1) to and/or from the tub. The second rack 130 may be positioned below the first rack 30 as shown in the one embodiment. The first rack 30 may engage the dishwasher tub 14 and be positioned between a first stowed position (e.g. in the dishwasher tub, see FIG. 5) and a first deployed position (e.g. different from the first stowed position, see FIG. 7). In some embodiments as shown in FIG. 7, the first deployed position of the first rack 30 may not be a fully deployed position (see FIG. 8). The second rack 130 may engage the dishwasher tub 14 and be positioned between a second stowed position (e.g. in the dishwasher tub, see FIG. 5) and a second deployed position (e.g. different from the second stowed position). When deploying the second rack from the second stowed position to the second deployed position correspondingly deploys/actuates the first rack 30 from the first stowed position to the first deployed position and/or exhibiting position. Stated alternatively, the first rack 30 deploys after/during deployment of the second rack 130. The second rack 130 (e.g. second member 136) releasably engages the first rack 30 (e.g. first member 36) when the second rack 130 is in the second deployed position (see FIG. 6), less than a third deployed position (see FIG. 7) or the second fully deployed position, and the first rack 30 is in the first stowed position. The third deployed position of the second rack 130 may be the fully deployed position of the second rack in some embodiments. When the second rack is in the second deployed position (see FIG. 6) and the first and second racks (e.g. first and second members) are engaged, the first rack 30 may be carried/actuated/deployed to the first deployed position (see FIG. 7) to make the presence of the first rack known/shown to the user by further deploying the second rack to a further/third deployed position or second fully deployed position of the second rack. As shown in FIG. 7, when the first rack 30 in the first deployed position, a portion of the first rack 30 may extend through the through opening 13 of the dishwasher tub. As shown in FIG. 8, when the second rack 130 is in the third deployed position or second fully deployed position, the first rack 30 may be further deployed to another deployed position or a first fully deployed position, further from the first deployed position, to unload/load the contents of the first rack. This increased deployment travel or further deployment of the first rack 30 from the first deployed position to another first deployed position releases the first rack 30 (e.g. first member 36) from the second rack 130 (e.g. second member 136). Further, when the first rack 30 is in the first deployed position (e.g. first fully deployed position, See FIG. 8), the first rack 30 may be stowed towards the first stowed position thereby reengaging the first rack (e.g. first member) with the second rack (e.g. second member). Further as shown in the one embodiment in FIG. 5, the first rack 30 (e.g. first member 36) is disengaged from the second rack 130 (e.g. second member 136) when both the second rack 130 is in the second stowed position and the first rack 30 is in the first stowed position.

In some implementations, the racks 30/130 may include one or more members to actuate the rack 30 to an exhibiting/deployed position to make the user aware of the rack's presence. The members/racks may have an interference engagement with each other to actuate at least one rack to one or more positions. The first rack 30 may include at least one first member 36. The second rack 130 may include at least one second member 136. The first member 36 may releasably engage/disengage the second member 136 when actuating the first rack 30. The first member 36, if used, may be positioned adjacent the front side 32, bottom edge 34, and/or bottom side/wall 38 of the first rack 30. The first member 36 may project downwardly from the first rack 30 (e.g. front side, bottom edge, bottom side, etc.) and/or towards the second rack 130. The first member 36 may be a loop shaped member as shown in the one embodiment. The loop may have a through opening having an axis parallel to the direction of travel of the racks 30/130. The second member 136, if used, may be positioned adjacent the back side 132, top edge 133, and/or top wall/side 134 of the second rack 130. The second member 136 may project upwardly from the second rack 130 (e.g. front side, bottom edge, bottom wall, etc.) and/or towards the first rack 30. The second member may be a hook shaped member as shown in the embodiments. The hook may be adjacent the distal free end and face the front opening 13 and/or away from the back side 132. The hook/first member may enter the through opening of the loop/second member when engaging the second rack to the first rack. The first member 36 and the second member 136 overlap or interfere with each other in a vertical distance or overlap in elevation to engage and/or disengage with each other during the changes in horizontal positions of the first rack and/or second rack during deploying/stowing as shown in the Figures. The first member 36 and the second member 136 may have a distance (e.g. in the horizontal direction, second distance D2) therebetween when disengaged. For example, when each rack is in the stowed positions there is a second distance between the first member 36 and the second member 136. The second distance D2 therebetween may be increased/decreased when stowing/deploying the first/second rack. The second distance D2 may decrease when the racks, or portions thereof, engage/approach each other and may increase when the racks, or portions thereof, disengage from each other. As shown in FIG. 6, for example, the second distance D2 may be reduced/decreased (e.g. zero) when the stowed second rack 130 deploys to the second deployed position and the first rack is in the first stowed position. Further for example, the second distance D2 may increase when the second rack is stowed and/or the first rack is deployed when the racks are engaged as shown in FIG. 7 (e.g. when the first rack is in the first deployed position and the second rack is in the second deployed position). It should be understood that the engagement (e.g. first member and/or second member) between the racks may be a variety of shapes, sizes, quantities, constructions, and positions within the corresponding racks and still be within the scope of the invention.

In some embodiments, the first rack 30 and/or second rack 130 may deploy/stow relative to the dishwasher tub in one or more elevations therebetween. The first rack 30 and/or second rack 130 may be fixed in elevation relative to the dishwasher tub 14 and/or adjustable in elevation relative to the dishwasher tub 14. For example, both the first rack 30 and second rack 130 may be fixed in elevation. Moreover, in some embodiments, the first rack may be fixed in elevation relative to the dishwasher tub and the second rack may be adjustable in elevation/height relative to the dishwasher tub. The engagement between the first member 36 and second member 136 may vertically overlap or have a vertical overlap V1 in elevation to engage and/or disengage therefrom when traveling between stowing/deploying. It should be understood that the vertical overlap or interference V1 between the first member and second member may decrease when the elevation distance or spacing between the first and second racks are increased. It should be understood that the vertical overlap or interference V1 between the first member and second member may increase when the elevation distance or spacing between the first and second racks are decreased. In some embodiments, the racks may be separated enough in elevation to disengage the actuation/engagement between the racks during stowing/deploying and/or vertical overlap V1 of the first member and second member if desired or in some applications.

In some implementations, the door and/or appliance, or portions thereof, may actuate the rack 30 to at least one deployed position (e.g. not the fully deployed position). In the one embodiment shown in FIGS. 10-13, the door/appliance may magnetically actuate (e.g. stow and/or deploy) the rack 30. The door 12 may carry, pull, push, engage, stow, deploy, couple with, and/or transport the rack 30 for one or more distances (e.g. first distance D1) to and/or from the tub. The door 12 and the rack 30 may magnetically engage/disengage from each other during operation (e.g. during stowing/deploying of the rack 30, during opening and closing of the door). When positioning the door 12 from the closed position to the open position, the rack 30 may be deployed from the stowed position (see FIG. 10) to the deployed/exhibiting position (see FIG. 11) by the magnetic engagement 50 between the door 12 and the rack 30. The magnetic engagement 50 may occur when both the door 12 is in at least the closed position and the rack 30 is in at least the stowed position as shown in the one embodiment in FIG. 10. The magnetic engagement may occur between the door 12 and rack 30 until magnetic disengagement occurs when the opening door 12 separates from the rack 30. When the door 12 is magnetically disengaged and the rack 30 is in the deployed/exhibiting position, the rack 30 may be further stowed/deployed from the deployed position. The door 12/appliance 10, or portions thereof, may magnetically actuate the rack 30 away from the stowed position to at least one deployed/exhibiting position of one or more deployed positions. The at least one deployed position when the door 12 engages/disengages from the rack (e.g. stowing, deploying) may be a position other than the fully deployed position in various embodiments. For example, as shown in FIG. 11, when the rack 30 is in at least one deployed position a portion of the rack may be positioned through the front opening 13 away from the tub 14 or stowed position whereby the rack's presence becomes known to the user. The door 12/appliance 10, or portions thereof, when opening maintains engagement to the rack 30 via the magnetic attraction/actuation between the door 12 and rack 30 thereby carrying/combining the rack with the door. The rack may travel substantially horizontally with the door away from the dishwasher tub to the deployed position, while the door pivots towards the open position. The door 12/appliance 10, or portions thereof, may magnetically separate from the rack 30 when in at least one deployed position. The door 12 may magnetically separate from the rack 30 upon the rack 30 reaching a distance (e.g. first distance D1) from the stowed position when the door 12 continues to open and/or pivot from the dishwasher tub/opening. The relative movement of the rack 30 (e.g. linear/horizontal movement) and door 12 (e.g. arcuate movement about the hinge 19) are restrained to different paths and will magnetically separate from each other after the paths diverge from each other and/or after traveling together for the distance (e.g. first distance D1) to the deployed position of the rack. Upon magnetically separating, the rack 30 may continue to deploy to another deployed position (e.g. fully deployed position) further away from the stowed position and/or previous deployed/exhibiting position. When the door 12 closes from the open position to the closed position, the door may magnetically engage/couple back to the rack and proceed to actuate the rack back to the stowed position. The rack (e.g. magnetic member, magnet) may be in one or more deployed positions or the stowed position when magnetically recoupled/engaged to the door (e.g. magnetic member, magnet) upon closing the door.

In some implementations, one or more magnetic couplings or magnetic actuations 50 between the rack 30 and the remainder of the appliance (e.g. door 12) may be a variety of constructions, quantities, shapes, sizes, and positions relative to the rack and still be within the scope of the invention. As shown in the one embodiment in FIGS. 10-13, the one or more magnetic couplings 50 may include one or more magnets 52 to magnetically/releasably anchor to a magnetic surface or member 54 (e.g. latch catch 56). The magnetic member 54 and/or latch catch 56, if used, may include one or more metal members 55. Although the door 12 includes the one or more magnetic members 54 and the rack 30 includes the one or more magnets 52, it should be understood that either one of the door 12 or the rack 30 may include portions of the magnetic coupling 50 (e.g. magnet(s), magnetic member). For example, the door 12 may include at least one magnet 52 and the rack 30 may include at least one magnetic member 54 in some embodiments.

Figure 13:
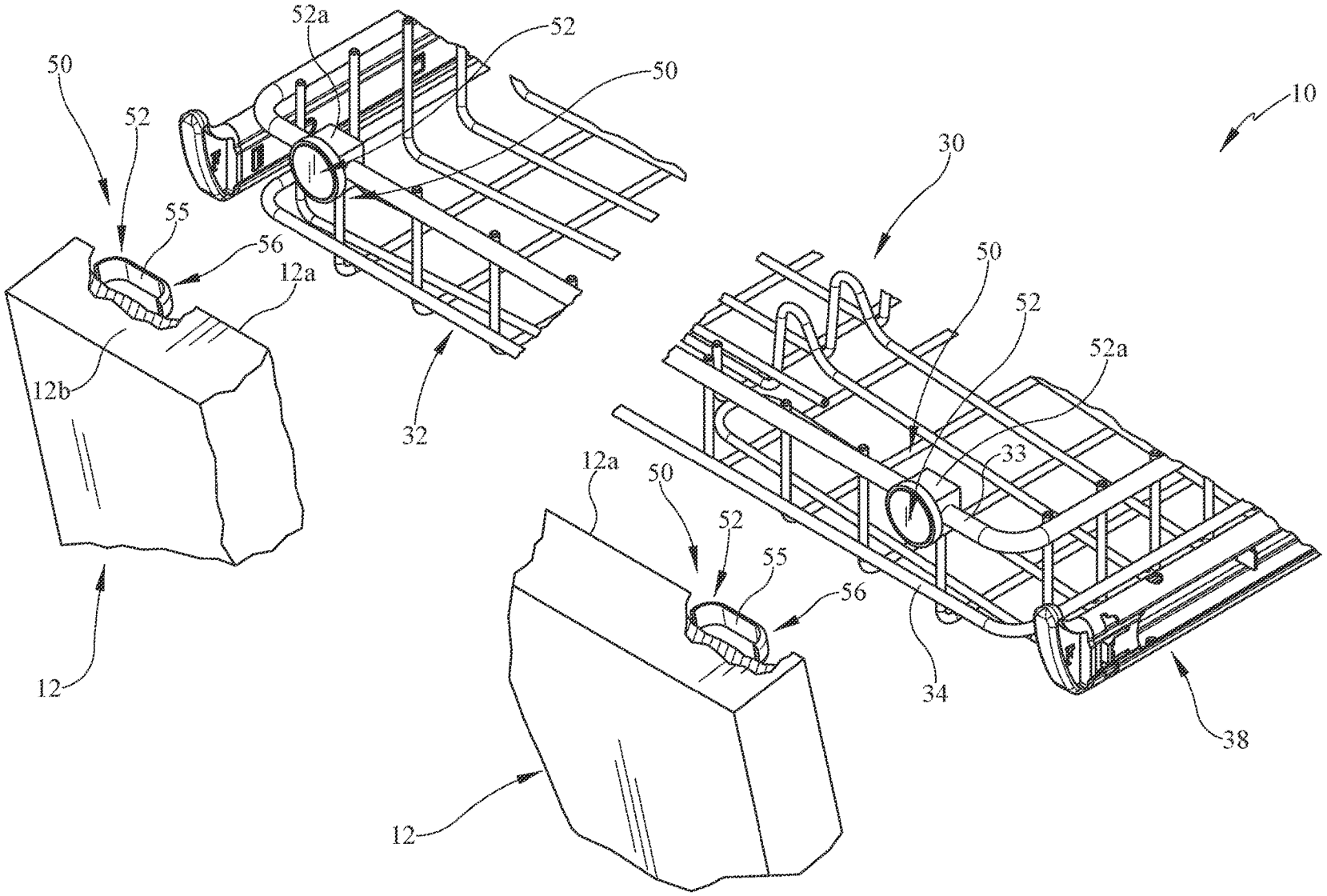
FIG. 13 is a perspective view of the rack of FIG. 10 illustrating the open door magnetically separated/disengaged from the rack in the deployed position.

In some implementations, the magnetic member 54, latch catch 56, door 12, and/or appliance 10 may include at least one metal member 55. As shown in the one embodiment in FIGS. 10-13, the magnetic member 54 may be a latch catch 56 projecting from the door/rack. The magnetic member 54/latch catch 56 of the door 12 may include one or more metal members or plates 55 coming into proximity with the one or more magnets of the rack 30 with opening/closing the door 12. The latch catch 56 and/or magnetic member 54 magnetically engages/disengages from the one or more magnets 52 of the rack 30 when the rack is deployed/stowed. The door 12 may include an interior side 12*a* between a top edge 12*b* and a bottom edge 12*c* (e.g. adjacent the hinge 19). The magnetic member 54 and/or latch catch 56 may be adjacent the top edge 12*b* of the door 12 on the interior side 12*a* as shown in the one embodiment. Although the latch catch 56 is shown as a pair of U-shaped members projecting from a non-magnetic surface of the door interior side 12*a*, it should be understood that the magnetic member or latch catch may be a variety of shapes, sizes, quantities, constructions, and positions on the door and still be within the scope of the invention. The rack 30 may include at least one magnet 52 magnetically releasably with the magnetic member 54 (e.g. latch catch, metal member(s)) of the door 12. The one or more magnets 52 may be positioned on the front side 32 of the rack 30. As shown in FIG. 13, the one or more magnets 52 may be a pair of magnets 52 adjacent opposing sides of the rack 30 or handle 31, if used. Correspondingly, one or more magnetic members 54 may be a pair of magnetic members located on the door interior 12*a*. The magnet 52 may include a body 52*a* (e.g. plastic) attached to the rack or rack wire (e.g. front side 32, top edge 33). The body 52*a* may receive one or more magnets 52, or portions thereof. Although the magnets are shown as a pair of magnets positioned on the front side 32 and top edge 33 of the rack 30, it should be understood that the magnet may be a variety of shapes, sizes, quantities, constructions, and positions on the rack and still be within the scope of the invention. The one or more magnetic couplings 50 temporally combines the rack with the door until the door is opened and the rack 30 reaches the deployed position and magnetically released. The magnetic coupling 50 release may occur when a sufficient force from the door 12 or movement/path of the door 12 overcomes the magnetic force (e.g. between the one or more magnets and the magnetic members) relative to the rack's position/path. The magnetic coupling 50 may be magnetically engaged (e.g. one or more magnets magnetically engaged to the magnetic member (e.g. latch catch)) when both the door 12 is in the closed position and the rack 30 is in the stowed position. When opening the door 12 towards the open position, the rack 30 is deployed with the door corresponding to the one of more magnets 52 magnetically/releasably engaging/actuating the magnetic member 54 (e.g. latch catch) until reaching the first deployed position of the rack. Continued opening movement of the door 12 from the deployed position of the rack 30 then magnetically/releasably disengages the magnetic member 54 from the one or more magnets 52. When the rack 30 is in the deployed position (e.g. not in the fully deployed position, exhibiting position, fully deployed position), a portion of the rack is positioned through the front opening 13 away from the dishwasher tub 14. When closing the door from the open position towards the closed position, the one or more magnets 52 may magnetically engage the magnetic member 54 (e.g. latch catch) in at least the stowed position.

Although the actuation of the rack 30, or portions thereof, (e.g. handle) may be actuated by manual manipulation of another structure of the appliance (e.g. door, adjacent/another rack) as shown in the Figures, it should be understood that the corresponding structure (e.g. door, adjacent/another rack) may be automatic or powered (e.g. motorized) in some embodiments and still actuate the rack 30, or portions (e.g. first portion, handle, etc.) thereof, to a deployed/exhibiting position (e.g. through front opening 13 for a first distance).

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising:

a dishwasher tub having a front opening;

a rack engaging the dishwasher tub, wherein the rack is positionable between a first stowed position in the dishwasher tub and a first deployed position different from the first stowed position;

wherein the rack includes a first portion interconnected to a remaining portion by at least one biasing mechanism, wherein the first portion is positionable between a second stowed position with the remaining portion and a second deployed position different from the second stowed position; and wherein the at least one biasing mechanism is formed between the first portion and the remaining portion, wherein the biasing mechanism urges the first portion to the second deployed position in front of the remaining portion towards the front opening of the dishwasher tub.

2. The dish washing appliance of claim 1 wherein the first portion includes a handle.

3. The dish washing appliance of claim 1 wherein the rack further includes one or more linkage members interconnecting the first portion to the remaining portion of the rack.

4. The dish washing appliance of claim 1 further comprising a door positionable between an open position and a closed position relative to the dishwasher tub, and wherein when the door opens from the closed position to the open position, the door actuates the first portion from the second stowed position to the second deployed position and correspondingly decreases a force of the biasing mechanism.

5. The dish washing appliance of claim 4 wherein when the door closes from the open position to the closed position, the door actuates the first portion from the second deployed position to the second stowed position and correspondingly increases the force of the biasing mechanism.

6. The dish washing appliance of claim 1 wherein the first portion travels at least linearly from the second stowed position to the second deployed position.

7. The dish washing appliance of claim 1 wherein when the rack is in the first stowed position and the first portion is in the second deployed position, the first portion is positioned through the front opening away from the dishwasher tub.

8. A dish washing appliance comprising:

a dishwasher tub having a front opening;

a rack engaging the dishwasher tub, wherein the rack is positionable between a first stowed position in the dishwasher tub and a first deployed position different from the first stowed position;

wherein the rack includes a handle and at least one biasing mechanism, wherein the handle is positionable between a second stowed position and a second deployed position different from the second stowed position; and wherein the at least one biasing mechanism is formed between the handle and the rack, wherein the biasing mechanism urges the handle to the second deployed position towards the front opening of the dishwasher tub.

9. The dish washing appliance of claim 8 wherein the dishwasher tub includes a top wall, wherein the rack is adjacent to the top wall.

10. The dish washing appliance of claim 8 wherein the dishwasher tub includes a door positionable relative to the dishwasher tub, wherein the door actuates the handle between the second stowed position and the second deployed position.

11. The dish washing appliance of claim 10 wherein when opening the door relative to the dishwasher tub decreases a force of the biasing mechanism.

12. The dish washing appliance of claim 8 wherein the rack further includes one or more linkage members interconnecting the handle to a remaining portion of the rack.

13. The dish washing appliance of claim 8 wherein the handle travels at least linearly from the second stowed position to the second deployed position.

14. The dish washing appliance of claim 8 wherein the rack includes a front side, and wherein the handle is in the second stowed position adjacent the front side of the rack.

15. The dish washing appliance of claim 8 wherein the handle is positionable in the second stowed position and the second deployed position when the rack is in the first stowed position.

16. A method of deploying a handle of a rack within a dish washing appliance comprising the steps of:

providing a door positionable between a closed position and an open position relative to a dishwasher tub;

providing a dishwasher rack having a handle, a remaining portion, and a biasing mechanism between the handle and the remaining portion; and deploying the handle from a stowed position to a deployed position relative to the remaining portion of the rack when positioning the door from the closed position to the open position.

17. The method of claim 16 further comprising the steps of decreasing a force of the biasing mechanism when positioning the door from the closed position to the open position, and increasing the force of the biasing mechanism when positioning the door from the open position to the closed position.

18. The method of claim 16 further comprising the step of stowing the handle from the deployed position to the stowed position relative to the remaining portion of the rack when positioning the door from the open position to the closed position.

19. The method of claim 16 further comprising the step of disengaging the door from the handle of the rack when positioning the door from the closed position to the open position.

20. The method of claim 16 further comprising the step of biasing the handle towards a front opening of the dishwasher tub when the rack is in a stowed position.

* * * * *